US008234816B2

(12) United States Patent
Heuel et al.

(10) Patent No.: US 8,234,816 B2
(45) Date of Patent: Aug. 7, 2012

(54) DOOR FOR A MOTOR VEHICLE

(75) Inventors: Gerd Heuel, Olpe (DE); Ralf Rottmann, Drolhagen (DE); Dirk Rau, Finnentrop (DE)

(73) Assignee: Dura Automotive Plettenberg Entwicklungs-und Vertreibs GmbH, Plettenberg (DE)

( * ) Notice: Subject to any disclaimer, the term of this patent is extended or adjusted under 35 U.S.C. 154(b) by 885 days.

(21) Appl. No.: 11/347,006

(22) Filed: Feb. 3, 2006

(65) Prior Publication Data

US 2006/0175867 A1 Aug. 10, 2006

(30) Foreign Application Priority Data

Feb. 4, 2005 (DE) ..... 10 2005 005 329
Mar. 7, 2005 (DE) ..... 10 2005 010 395
Oct. 12, 2005 (DE) ..... 10 2005 048 786

(51) Int. Cl.
*E05D 15/10* (2006.01)

(52) U.S. Cl. ..... 49/216; 49/211; 49/223

(58) Field of Classification Search ..... 49/206, 49/211, 213, 214, 215, 216, 223, 225, 254
See application file for complete search history.

(56) References Cited

U.S. PATENT DOCUMENTS 4,068,407 A * 1/1978 Podolan et al. ..... 49/215
4,110,934 A * 9/1978 Zens ..... 49/218
4,651,594 A * 3/1987 Vogel et al. ..... 475/12
4,802,307 A * 2/1989 Schmidt ..... 49/219
4,862,640 A * 9/1989 Boyko et al. ..... 49/213
5,383,304 A * 1/1995 Codina Soley ..... 49/215
5,896,704 A * 4/1999 Neag et al. ..... 49/209
5,921,613 A * 7/1999 Breunig et al. ..... 296/155
5,992,097 A * 11/1999 Makiuchi et al. ..... 49/216
6,036,257 A * 3/2000 Manuel ..... 296/155
6,216,393 B1 * 4/2001 Apprich ..... 49/212
6,328,374 B1 * 12/2001 Patel ..... 296/155
6,386,621 B1 * 5/2002 Kozak et al. ..... 296/155
6,477,807 B1 * 11/2002 Crondahl et al. ..... 49/211
6,606,763 B1 * 8/2003 Bruckner ..... 16/366
6,793,268 B1 * 9/2004 Faubert et al. ..... 296/146.12
6,926,342 B2 * 8/2005 Pommeret et al. ..... 296/155
2003/0204999 A1 * 11/2003 George et al. ..... 49/216
2004/0075285 A1 * 4/2004 Murayama et al. ..... 292/265
2005/0235564 A1 * 10/2005 Fronz et al. ..... 49/209
2006/0225356 A1 * 10/2006 Jarolim ..... 49/209

FOREIGN PATENT DOCUMENTS

DE 3026037 1/1982
GB 2049774 A * 12/1980

* cited by examiner

*Primary Examiner* — Gregory J. Strimbu
(74) *Attorney, Agent, or Firm* — Alleman Hall McCoy Russell & Tuttle LLP

(57) ABSTRACT

A door that is pivotable and slidable relative to a vehicle includes an articulated arm pivotably supported at a pivot joint, a guide carriage displaceably guided by a guide rail and coupled to the pivot joint, a tie rod, the tie rod being hingedly connected to the guide carriage, and a spring-loaded index bolt which is vertically displaceable. The door further comprises a rotary slide having a rotary slide surface which dictates vertical movement of the index bolt between a first position in which the articulated arm and the tie rod are engaged by the index bolt so that the articulated arm and the tie rod rotate in unison and a second position in which the tie rod is disengaged from the index bolt so that the articulated arm pivots relative to the tie rod.

16 Claims, 11 Drawing Sheets

DOOR FOR A MOTOR VEHICLE

CROSS REFERENCE TO RELATED APPLICATION

This application claims priority to German Patent Application Serial No. 10 2005 005 329.7 filed Feb. 4, 2005, German Patent Application Serial No. 10 2005 010 395.2 filed Mar. 7, 2005, and German Patent Application Serial No. 10 2005 048 786.6 filed Oct. 12, 2005, all of which are hereby incorporated by reference in their entirety for all purposes.

FIELD

The present disclosure relates to a door for a vehicle, in particular for a motor vehicle. The present disclosure furthermore relates to a vehicle, in particular to a motor vehicle. The present disclosure can be used in vehicles of all kinds, that is, in land vehicles, water vehicles and air vehicles.

BACKGROUND AND SUMMARY

A door for a motor vehicle, comprising a pivot joint at which an articulated arm hingedly connectable or connected to the vehicle is pivotably supported, is known from DE 30 26 037. It is a so-called sliding door. To open the door, it must first be pivoted out of the plane of the vehicle body. The door is subsequently displaced to the front or to the rear parallel to the vehicle body. The door accordingly includes a pivot joint to which an articulated arm is pivotably supported. The other end of the articulated arm is hingedly connected to the motor vehicle.

It is an object of the present disclosure to provide a door for a vehicle which can be opened and closed both as a sliding door and as a pivoting door.

This object is solved in accordance with the present disclosure by a door for a vehicle, in particular for a motor vehicle, comprising a pivot joint at which an articulated arm hingedly connectable or connected to the vehicle is pivotably supported, wherein the pivot joint at which the pivot arm is pivotably supported is lockable. When the door is to be opened as a pivoting door, the pivot joint is locked. The door can then be opened by turning the hinged connection of the articulated arm to the vehicle. When the door is to be opened as a sliding door, the lock of the pivot joint is released. On the opening of the door, the articulated arm is pivoted about the joint provided at the vehicle. The pivot joint is also pivoted—in the opposite direction—in this process so that the door is pivoted out of the plane of the body. It can then be displaced parallel to the vehicle body.

Advantageous further developments are also possible.

The pivot joint can preferably be locked in a plurality of pivot positions. It is advantageous for the pivot joint to be able to be locked in two pivot positions. The first pivot position is preferably that pivot position in which the pivot joint is located when the door is closed. When the pivot joint is locked in this pivot position, the door can be opened by a pivot movement, that is, as a pivot door. The second pivot position, in which the pivot joint can be locked, is preferably that pivot position in which the pivot joint is located when the articulated arm and the door have been pivoted such that the door is located at a spacing from the body of the vehicle and is located in a direction parallel to the body of the vehicle. In this locked pivot position, the door can then be displaced parallel to the vehicle body, that is, the door can be opened as a sliding door.

It is advantageous for the pivot range of the pivot joint to be limited.

A further advantageous further development is that the pivot joint is provided at a guide carriage which is displaceably guided in a guide rail. The guide rail is provided in the door.

In accordance with another advantageous further development, a tie rod is provided which is connected to the guide carriage. The tie rod is preferably hingedly connected to the guide carriage. The pivot axle of the tie rod at the guide carriage is preferably located at a spacing from the pivot joint of the articulated arm at the guide carriage.

Another advantageous further development is that the tie rod can be or is selectively connected to the articulated arm or hingedly to the vehicle. The joint axle between the tie rod and the vehicle is preferably located at the vehicle at the spacing of the pivot axle of the articulated arm.

In accordance with another advantageous further development, a first index bolt is present which can be brought into a position connecting the tie rod to the articulated arm. It is advantageous if a second index bolt is instead or additionally present which can be brought into a position hingedly connecting the tie rod to the vehicle. It is possible to provide a plurality of first index bolts and/or a plurality of second index bolts. It is advantageous if two first index bolts and/or two second index bolts are present. One or both index bolts can be spring-loaded. The first index bolt and/or the second index bolt can be brought into the described index position by a slide curve.

In accordance with another advantageous further development, a rotary slide is present by which the first index bolt can be brought into the position connecting the tie rod to the articulated arm. Instead or additionally, the second index bolt can be brought into the position hingedly connecting the tie rod to the vehicle by the rotary slide. The rotary slide is preferably provided at the vehicle at the pivot axle of the articulated arm.

It is advantageous for a lock lever to be pivotably supported at the guide carriage.

Another advantageous further development is that the lock lever has a guide groove for a lock bolt provided at the door. The guide groove is substantially directed toward the pivot axis of the lock lever.

In one example, a vehicle, in particular a motor vehicle, may include one or more doors in accordance with the present disclosure.

BRIEF DESCRIPTION OF THE FIGURES

Embodiments of the present disclosure will be explained in detail in the following with reference to the enclosed drawing. There are shown in the drawings.

DETAILED DESCRIPTION

Figure 1:
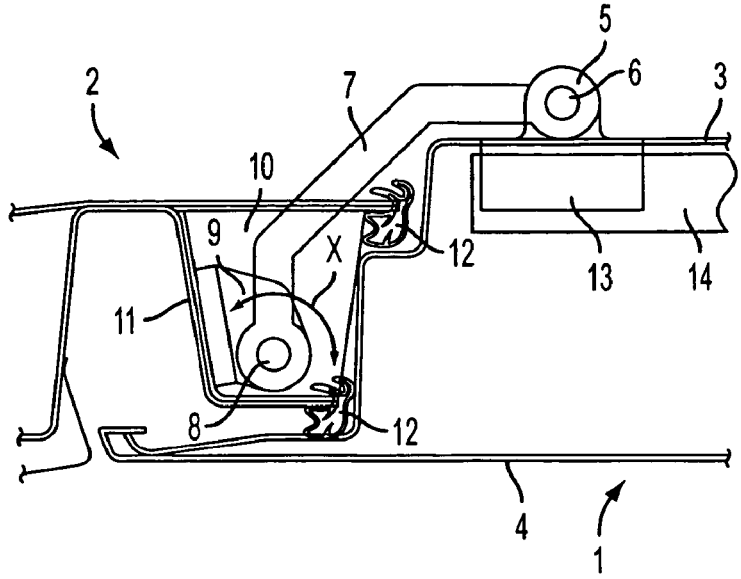
FIG. 1 is a door for a motor vehicle in the closed state in a sectional view from above.

The Figures of the drawing show a door 1 connected to a motor vehicle 2. The door 1 comprises a door box 3 and an outer panel 4. In the interior region of the door box 3 facing the vehicle 2, a pivot joint 5 is secured in which the swivel pin 6 of an articulated arm 7 is pivotably supported. The articulated arm 7 comprises a straight middle piece from which two respective end pieces angle off at an angle of approximately 45°.

The articulated arm 7 is provided at its other end with a further swivel pin 8 which is hingedly supported in a hinge 9. The hinge 9 is connected to the body of the motor vehicle. It is fastened to a panel 11 of the A pillar 10. A seal 12 is fastened to the peripheral flange of the door section.

The pivot joint 5 is provided at a guide carriage 13 which is displaceably guided in a guide rail 14 of the door 1. The guide rail 14 extends in the direction of the body, that is, in the longitudinal direction of the vehicle.

The pivot joint 5 can be locked. It can be locked both in the position shown in FIG. 1 and in the position shown in FIGS. 2 and 3.

Figure 4:
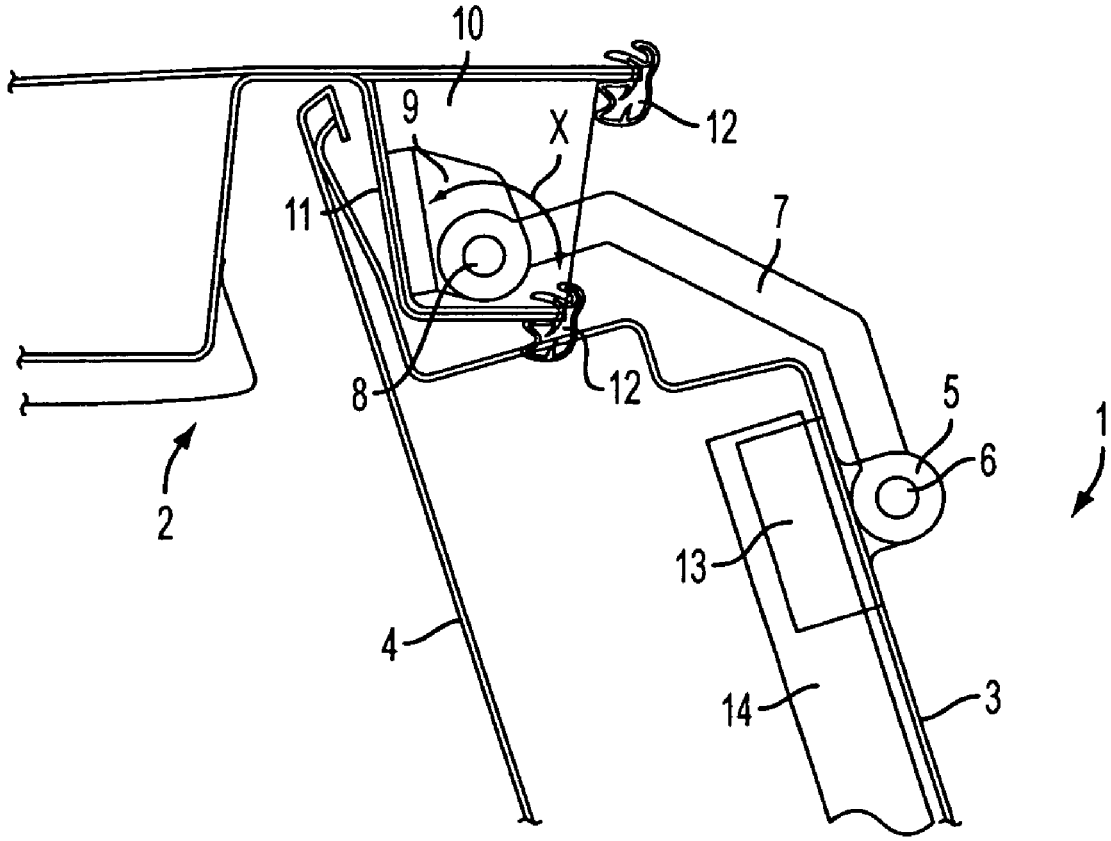
FIG. 4 is the door of FIGS. 1 to 3 in the state opened by a pivot movement.

When the door 1 should be opened by a pivot movement out of the closed position shown in FIG. 1, the pivot joint 5 is locked in the position shown in FIG. 1. Furthermore, the guide carriage 13 is locked in the position shown in FIG. 1. The door 1 still closed in FIG. 1 is opened like a conventional pivot door with a pivot movement around the hinge 9 until the open position shown in FIG. 4 is reached.

When the door should be opened by a sliding movement out of the closed position shown in FIG. 1, the locks of the pivot joint 5 and of the guide carriage 13 are released. The door 1 is subsequently pivoted into the position shown in FIG. 2. The articulated arm 7 pivots around the hinge 9 in a clockwise direction. The door 1 carries out a counterclockwise pivot movement relative to the articulated arm 7 in the pivot joint 5. During these pivot movements, the guide carriage 13 moves a certain distance to the rear in the guide rail 14 and then back into the position shown in FIG. 2. This distance can be limited by an abutment in the guide rail 14 (not shown in the drawing).

Figure 2:
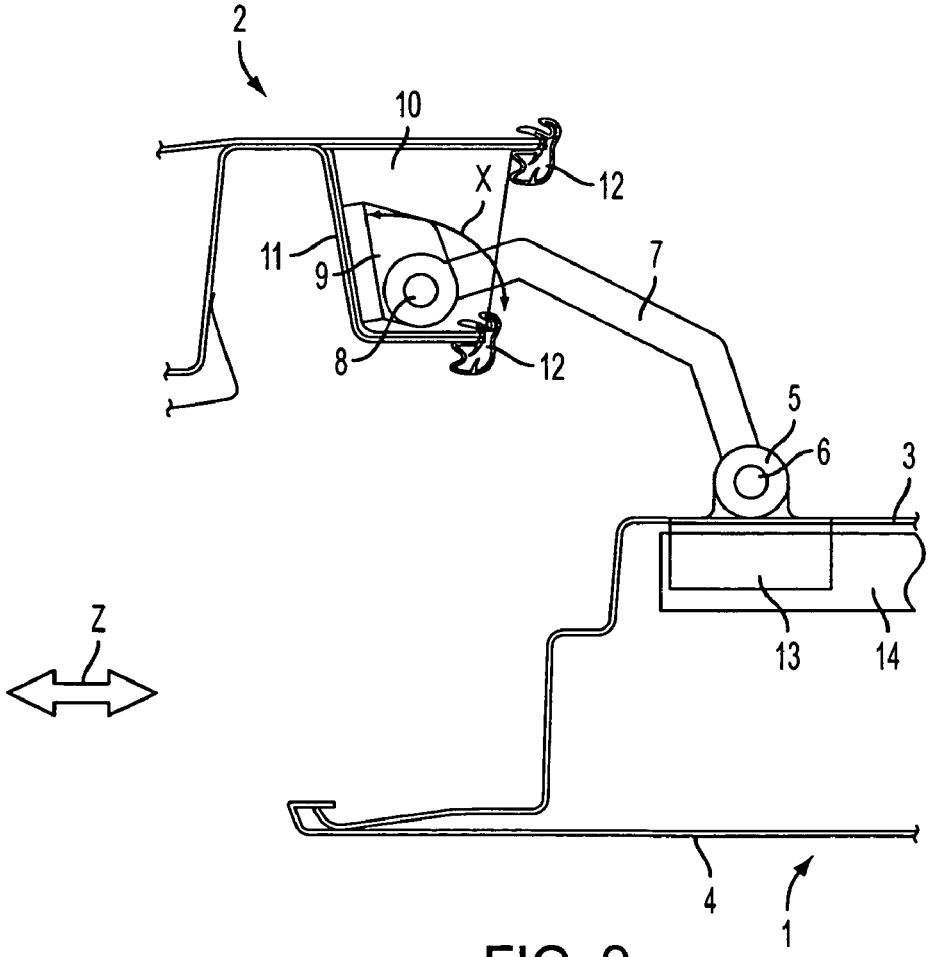
FIG. 2 is the door of FIG. 1 after a pivoting out of the plane of the body.
Figure 3:
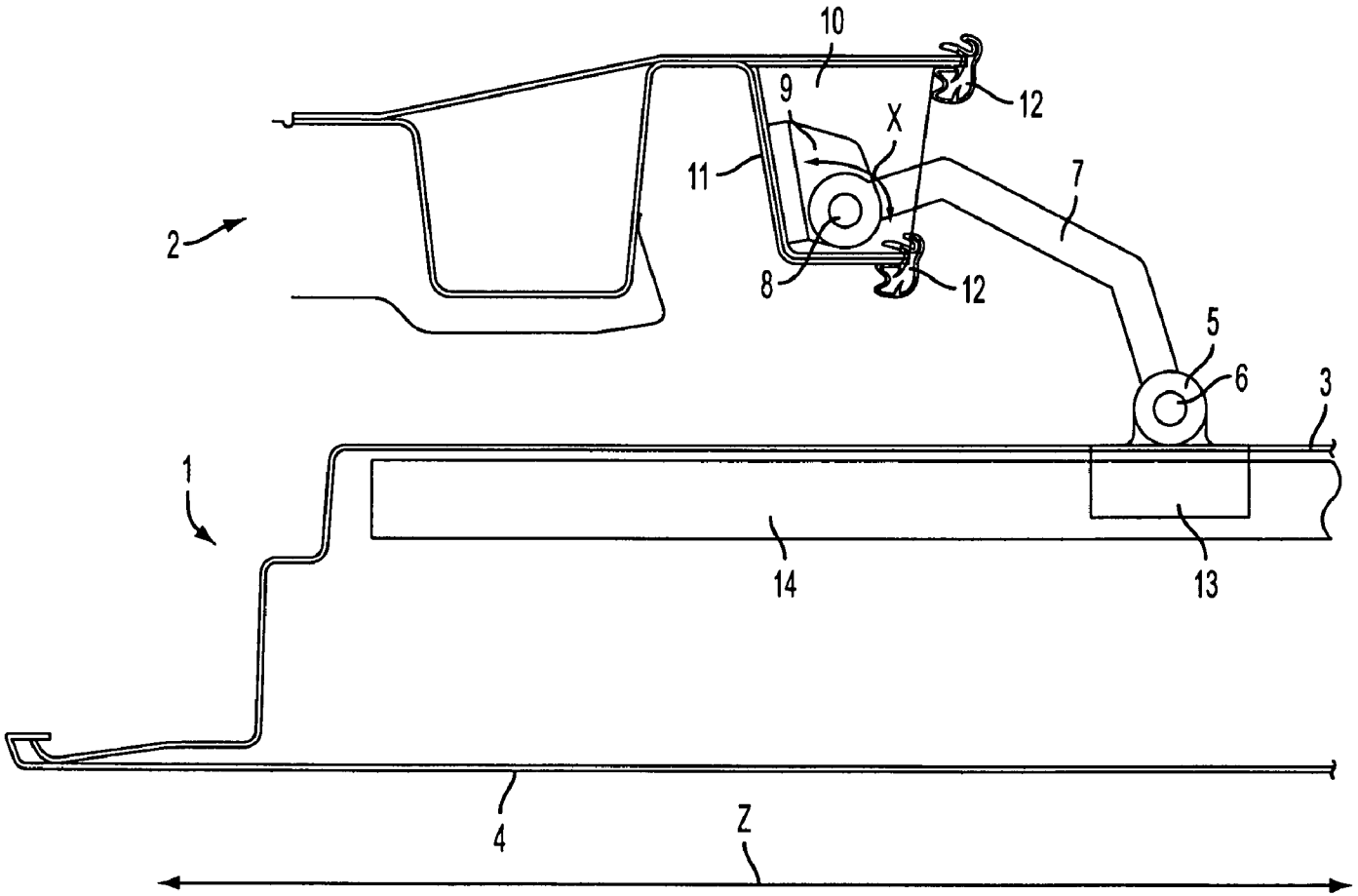
FIG. 3 is the door of FIGS. 1 and 2 in the partly displaced state.

When the position shown in FIG. 2 is reached in which the door 1 is located at a distance from the body of the vehicle and in which the door 1 is furthermore located in a direction parallel to the vehicle body, the pivot joint 5 is locked. Furthermore, the locking of the guide carriage 13 remains in the position of FIG. 2 or is released. The door 1 can then be displaced in the z direction, that is, in the direction parallel to the vehicle body or in the longitudinal direction of the vehicle. A corresponding position of the door 1, in which the door 1 is partly opened, is shown in FIG. 3.

The pivot range of the pivot joint 5 is restricted in the manner such that the door 1 cannot be pivoted clockwise beyond the position in FIG. 1 with respect to the articulated arm 7 and also not beyond the position shown in FIG. 2 with respect to the articulated arm 7 in a counterclockwise direction.

FIGS. 5 to 12 show a modified embodiment in which corresponding components are provided with the same reference numerals. In addition to the articulated arm 7, a tie rod 18 is present which is connected to the vehicle and to the guide carriage.

Figure 7:
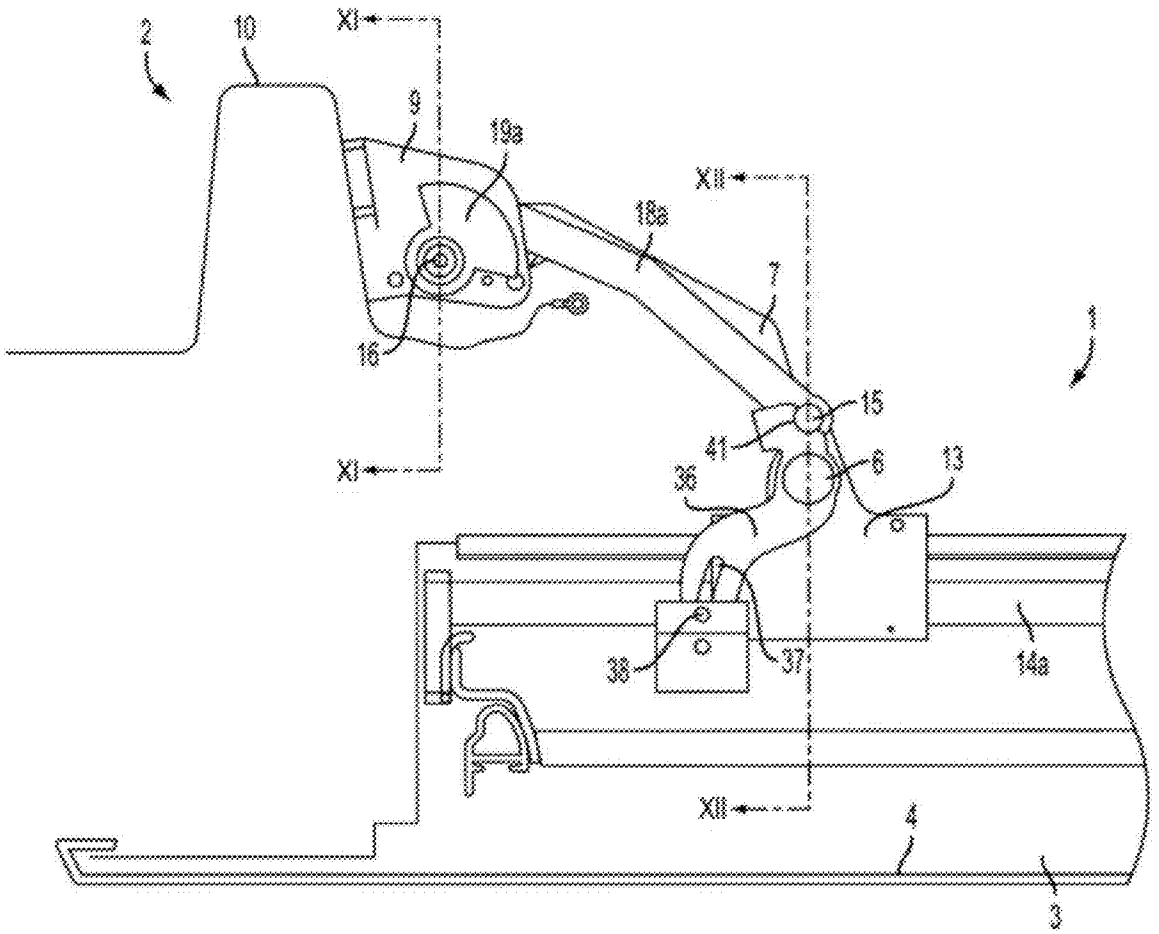
FIG. 7 is an enlarged partial view of FIG. 6.
Figure 11:
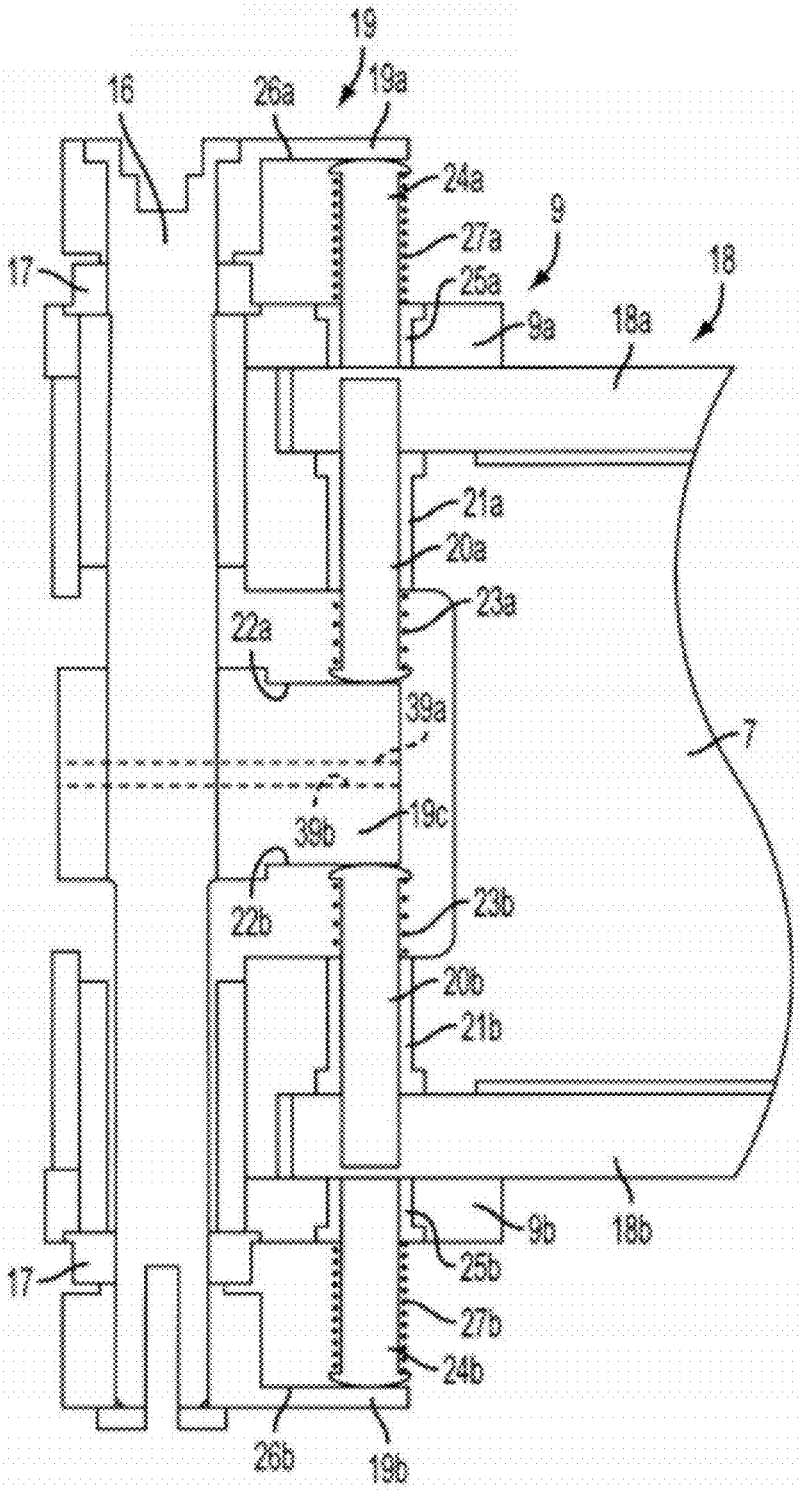
FIG. 11 is a section along the line XI-XI in FIG. 7.

FIG. 11 shows a section along the line XI-XI in FIG. 7 through the support shaft 16 which is rotatably supported by grooved ball bearings 17 at the hinge 9 connected to the body of the motor vehicle. The articulated arm 7 is pivotably supported at the support shaft 16. A tie rod 18 is furthermore present which includes an upper tie rod 18*a* and a lower tie rod 18*b*. The upper tie rod 18*a* is located between the articulated arm 7 and the upper part 9*a* of the hinge 9. The lower tie rod 18*b* is disposed between the articulated arm 7 and the lower part 9*b* of the hinge 9. The tie rods 18*a*, 18*b* are slidingly jammed in this manner between the articulated arm 7 and the parts 9*a* and 9*b* of the hinge 9.

A rotary slide 19 is rotationally fixedly connected to the support shaft 16 and has an upper part 19*a*, a lower part 19*b* and a middle part 19*c*. First index bolts 20*a*, 20*b* which are longitudinally displaceably guided in associated bearing bushings 21*a*, 21*b* are present in the articulated arm 7. The bearing bushings 21*a*, 21*b* extend parallel to and spaced from the bearing shaft 16. The head at the lower end of the upper first index bolt 20*a* lies on the upper slide curve of the middle part 19*c* of the rotary slide 19. In a corresponding manner, the head at the upper end of the lower first index bolt 20*b* lies on the lower slide curve 22*b* of the middle part 19*c* of the rotary slide 19. The first index bolts 20*a*, 20*b* are loaded toward the slide curves 22*a*, 22*b* by compression springs 23*a*, 23*b* which are provided between the bearing bushings 21*a*, 21*b* and the heads of the first index bolts 20*a*, 20*b*.

In a corresponding manner, second index bolts 24*a*, 24*b* are present in the upper and lower parts 9*a* and 9*b* of hinge 9 and are guided longitudinally displaceably in associated bearing bushings 25*a*, 25*b*. The bearing bushings 25*a*, 25*b* extend parallel to and spaced from the bearing shaft 16. The head at the upper end of the upper second index bolt 24*a* lies on the slide curve 26*a* at the lower side of the upper part 19*a* of the rotary slide 19. In a corresponding manner, the head at the lower end of the lower second index bolt 24*b* lies on the slide curve 26*b* at the upper side of the lower part 19*b* of the rotary slide 19. The second index bolts 24*a*, 24*b* coincide with the first index bolts 20*a*, 20*b*. The second index bolts 24*a*, 24*b* are loaded toward the slide curves 26*a*, 26*b* by compression springs 27*a*, 27*b* which are provided between the bearing bushings 25*a*, 25*b* and the heads of the second index bolts 24*a*, 24*b*.

Figure 12:
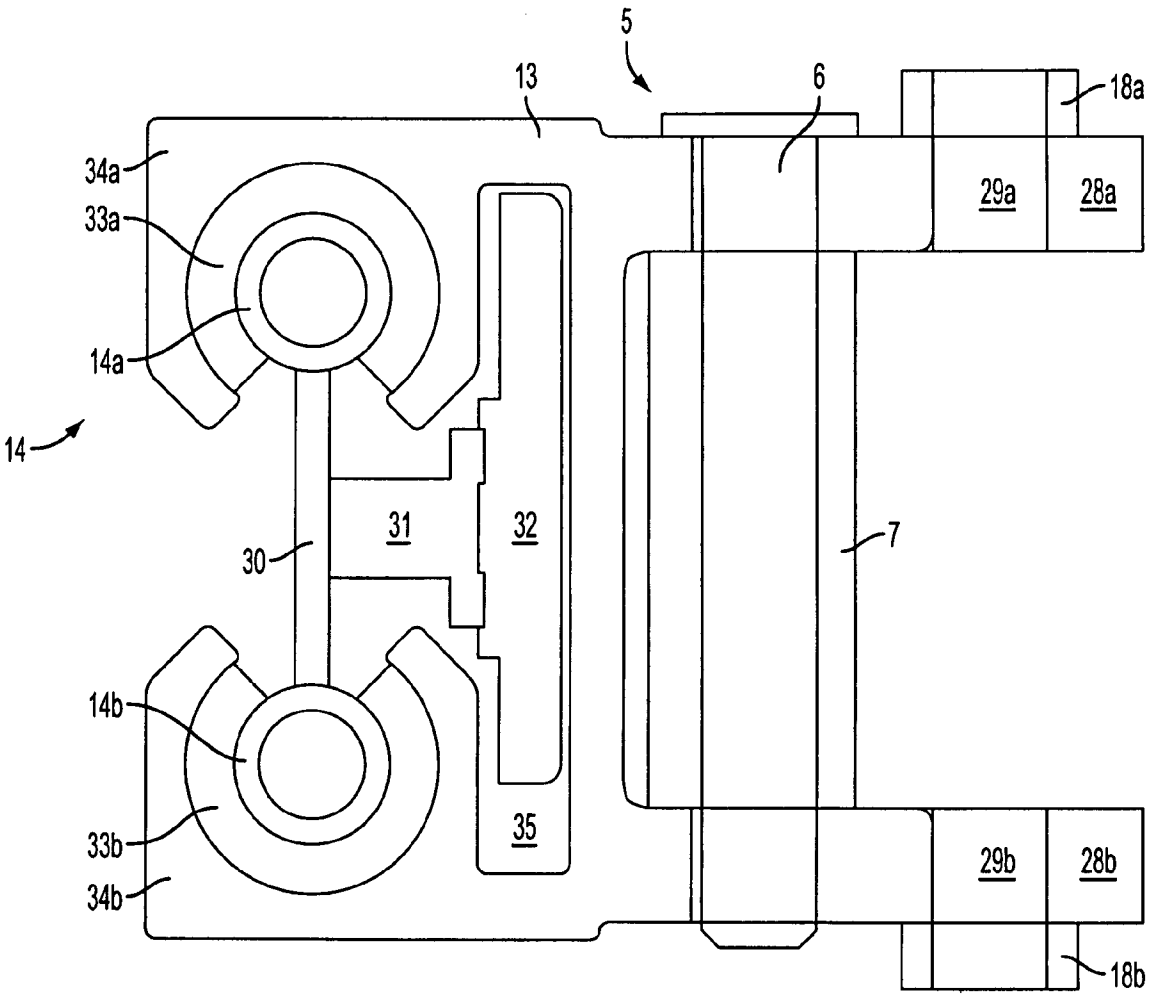
FIG. 12 is a section along the line XII-XII in FIG. 7.

As can be seen from FIG. 12, a pivot joint 5 is provided at the guide carriage 13 and a vertical swivel pin 6 is rotatably supported in it. The support positions are located in an upper support plate 28*a* and a lower support plate 28*b* which extend parallel to one another and spaced from one another and between which the articulated arm 7 is arranged which is likewise pivotably supported about the swivel pin 6.

Further support positions 29*a*, 29*b* for further swivel pins 15 (see FIGS. 5 to 10; not shown in FIG. 12) are provided spaced from the swivel pins 6 in the support plates 28*a*, 28*b* and the ends of the tie rods 18*a*, 18*b* are pivotably supported thereon.

As can likewise be seen from FIG. 12, the guide rail 14 comprises an upper rail 14*a* and a lower rail 14*b* which are arranged over one another and which are each made in tubular form. The rails 14*a*, 14*b* have an annular cross-section. They are connected to one another by a middle piece 30. The middle piece 30 has an elongated rectangular cross-section whose central axis is disposed in the connection plane of the centers of the rails 14*a*, 14*b*. It is provided at its center with a connection part 31 which faces the interior of the vehicle and to whose end a panel 32 is fastened which has a substantially rectangular cross-section. The panel 32 covers the rails 14*a*, 14*b* with respect to the interior of the vehicle. Its upper end projects over the upper rail 14*a*.

The guide carriage 13 comprises an upper support sleeve 33*a* and a lower support sleeve 33*b* which extend over an angular range of approximately 270° in each case and in which the rails 14*a*, 14*b* are longitudinally displaceably guided. The open regions of the support sleeves 33*a*, 33*b* face one another. They leave room for the middle part 30 of the guide rail 14.

The support sleeves 33*a*, 33*b* are supported by corresponding projections 34*a*, 34*b* of the guide carriage 13 which face one another in a corresponding manner and have a cut-out extending over an angular range of approximately 90° to provide space for the middle part 30 of the guide rail 14. A cut-out 35 for the panel 32 is provided in the guide carriage 13 in addition to the projections 34*a*, 34*b*. Adjacent thereto, the guide carriage 13 has the support plates 28*a*, 28*b*.

Furthermore, a lock lever 36 is provided at the guide carriage 13 which is pivotably supported around the axis of the swivel pin 6 (in FIG. 12 the lock lever 36 has been omitted for reasons of a simplified drawing representation). The lock lever 36 has a guide groove 37 in the region of its end which is open to its end and which is substantially directed toward the pivot axis of the lock lever 36, that is, toward the swivel pin 6. A lock bolt 38 provided at the door 1 can engage into the guide groove 37.

In FIG. 11, the basic position of the index bolts 20*a*, 20*b*, 24*a*, 24*b* is shown in which the first index bolts 20*a*, 20*b* rigidly connect the tie rods 18*a*, 18*b* to the articulated arm 7. In this position, the door 1 can be opened from the position shown in FIG. 5 by a rotary movement into the position shown in FIG. 9. As can be seen from FIG. 11, the first index bolts 20*a*, 20*b* engage through both the bearing bushings 21*a*, 21*b* of the articulated arm 7 and through the tie rods 18*a*, 18*b*. They end at a small distance in front of the hinges 9*a*, 9*b*. In this manner, the articulated arm 7 and the tie rods 18*a*, 18*b* are rigidly connected to one another, and indeed in the sense that the tie rods 18*a*, 18*b* are pivoted along in a compulsory manner on a pivoting of the articulated arm 7 about the support shaft 16.

The lock bolt 38 provided at the door 1 engages into the outer end of the guide groove 37 of the lock lever 36. In this manner, the lock bolt 38 locks the lock lever 36 and with it the guide carriage 13. The door can be opened like a conventional pivot door by a pivot movement about the support shaft 16 until the open position shown in FIG. 9 has been reached.

Figure 5:
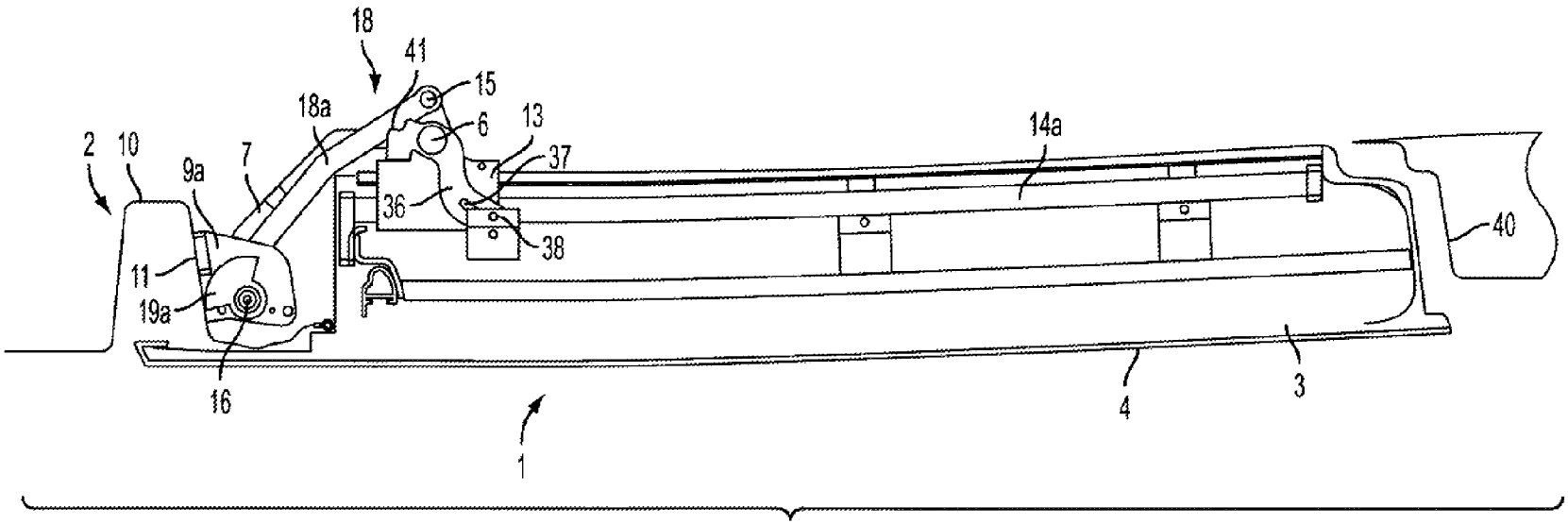
FIG. 5 is another embodiment of a door for a motor vehicle in the closed state in a sectional view from above.
Figure 6:
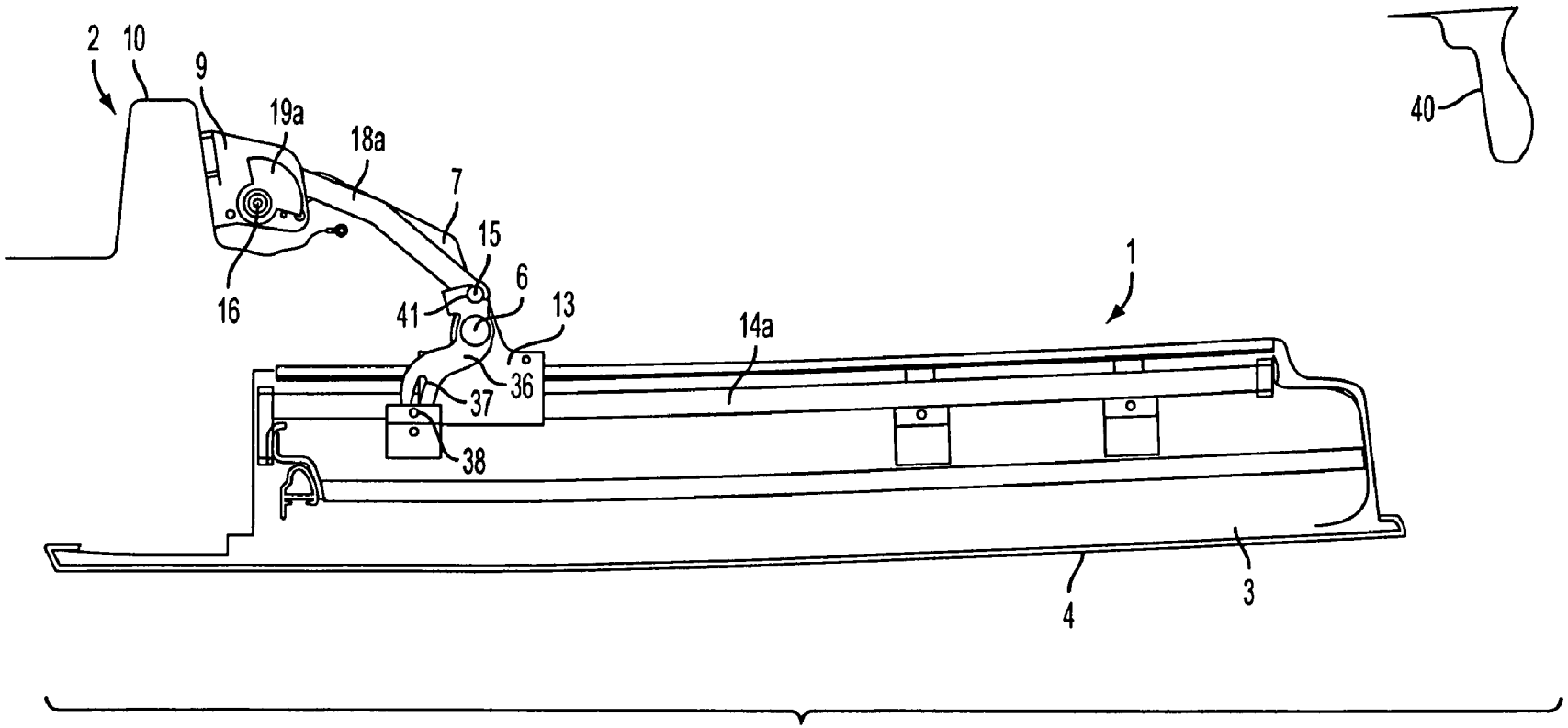
FIG. 6 is the door of FIG. 5 after a pivoting out of the plane of the body.
Figure 8:
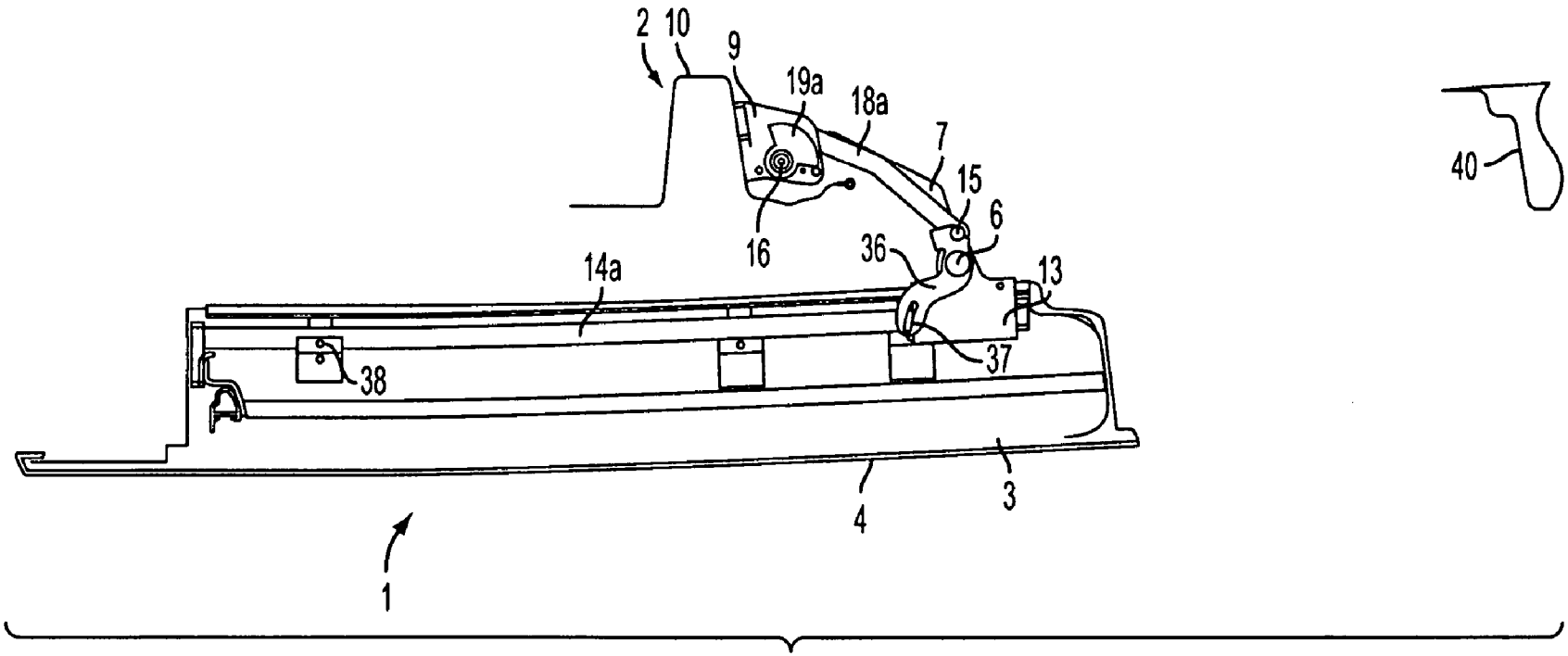
FIG. 8 is the door of FIGS. 5 to 7 in the fully displaced state.
Figure 9:
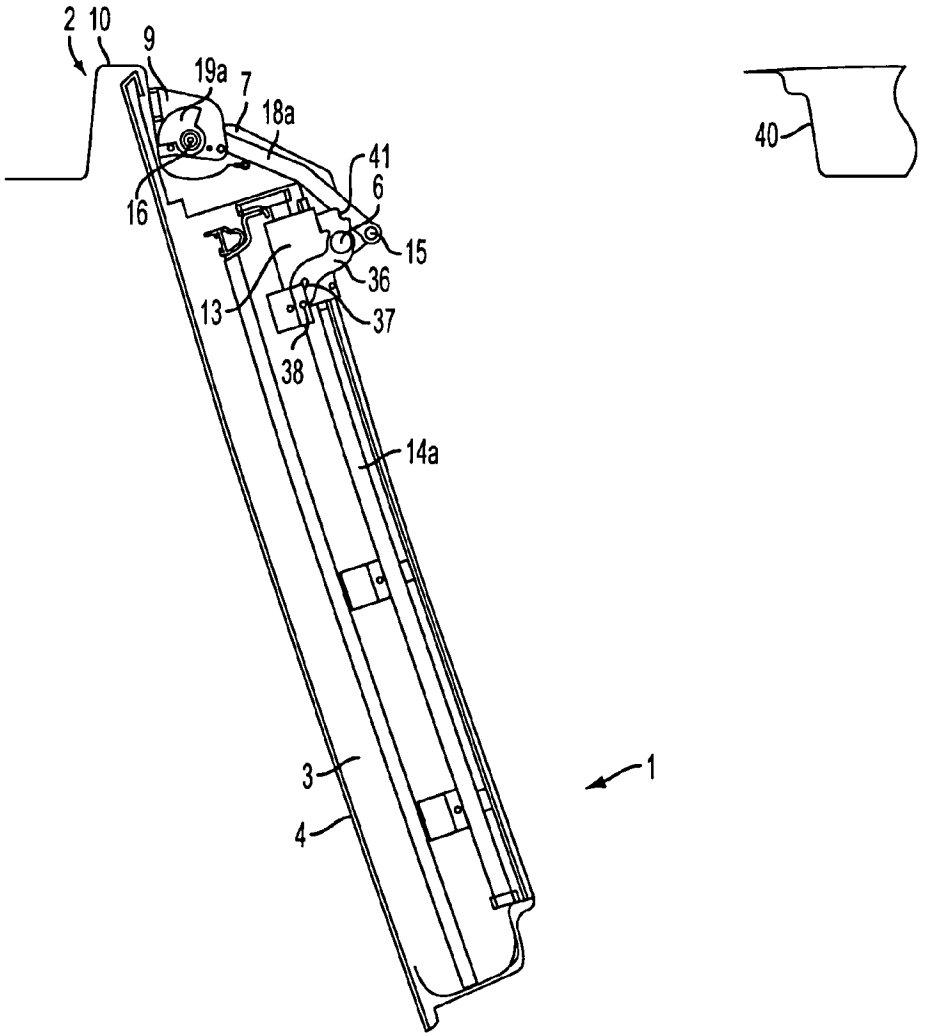
FIG. 9 is the door of FIGS. 5 to 8 in the state opened by a pivot movement.
Figure 10:
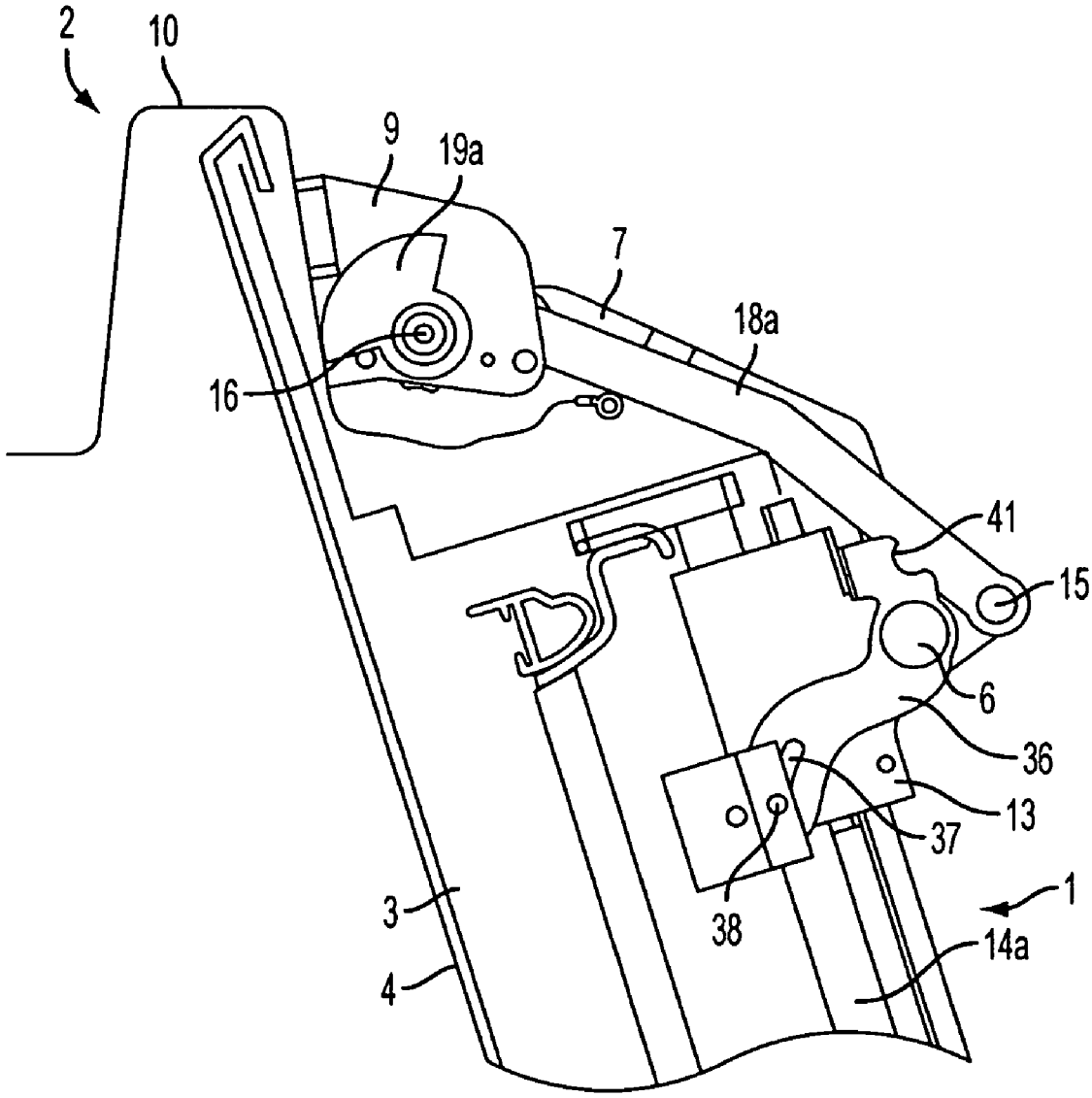
FIG. 10 is an enlarged part view of FIG. 9.

If the door 1 should be opened by a sliding movement out of the closed position shown in FIG. 5, the rotary slide 19 is rotated about 90° clockwise until it has reached the position shown in FIGS. 6, 7 and 8. The index bolts 20*a*, 20*b*, 24*a*, 24*b* are hereby displaced toward the middle part 19*c* of the rotary slide 19 by the thickness of the tie rods 18*a*, 18*b*. The head of the upper first index bolt 20*a* runs downwardly on the upper slide curve 22*a* of the middle part 19*c* of the rotary slide 19 until it has reached the level of the line 39*a*. This movement of the upper first index bolt 20*a* is supported by the force of the compression spring 23*a*. In a corresponding manner, the lower first index bolt 20*b* is held in contact with the lower slide curve 22*b* by the force of the compression spring 23*b*, said lower slide curve extending over the quarter-turn of the support shaft 16 at the level of the line 39*b*. The outer ends of the first index bolts 20*a*, 20*b* thus release the tie rods 18*a*, 18*b*.

The upper second index bolt 24*a* is pressed downwardly against the force of the compression spring 27*a* by the slide curve 26*a* at the lower side of the upper part 19*a* of the rotary slide 19 on the rotation of the rotary slide 19 until its lower end lies somewhat above the lower end face of the upper tie rod 18*a*. The lower second index bolt 24*b* is pressed upwardly in a corresponding manner against the force of the compression spring 27*b* by the slide curve 26*b* at the upper side of the lower part 19*b* of the rotary slide 19 on the rotation of the rotary slide 19 until its upper end lies somewhat below the upper end face of the lower tie rod 18*b*. In this manner, the second index bolts 24*a*, 24*b* establish a hinged connection between the tie rods 18*a*, 18*b* and the hinges 9*a*, 9*b*, that is a connection between the tie rods 18*a*, 18*b* and the vehicle.

The support shaft 16, the second index bolts 24*a*, 24*b*, the swivel pin 6 and the swivel pins 15 thus form a four-bar linkage in the support positions 29*a*, 29*b* of the guide carriage 13. When the articulated arm 7 is pivoted, the guide carriage 13 is taken along by the articulated arm 7 and thus pivoted about the support shaft 16. The guide carriage 13 is simultaneously pivoted in the opposite direction of rotation about the swivel pin 6 during this movement so that in the final analysis it is displaced in parallel by the action of the four-bar linkage.

Since the articulated arm 7 extends, starting from the support shaft 16, obliquely to the interior of the vehicle, on the rotation of the articulated arm 7 about the support shaft 16, the end of the door 1 facing away from the support shaft 16 would abut the oppositely disposed body part 40 so that the door 1 would be blocked and could not be opened any further. To prevent this, the guide groove 37 is present in the lock lever 36 and extends obliquely toward the swivel pin 6 and substantially arcuately about the support shaft 16. When the articulated arm 7 is pivoted, the guide groove 37 runs into the lock lever 38, whereby the lock lever 36 is pivoted in a clockwise direction around the swivel pin 6 with an increasing pivoting of the articulated arm 7. The guide carriage 13 is thereby moved in a direction away from the support shaft 16 relative to the door 1. Due to the associated relative movement of the door 1, it runs in a corresponding manner toward the support shaft 16 or away from the body part 40. The four-bar linkage, the lock lever 36, its guide groove 37 and the lock bolt 38 are matched to one another such that the door 1 is moved substantially at a right angle out of its opening in the body between the hinge 9 and the body part 40. The movement of the door 1 toward the body part 40 generated by the rotation of the articulated arm 7 per se is therefore substantially compensated by the described opposite movement of the guide carriage 13 until the door 1 has moved out of its opening and has adopted the position shown in FIG. 6.

In this position, the guide carriage 13 has moved in the guide 14 toward the body part 40. The lock lever 36 has been pivoted clockwise. The lock bolt 38 has run into the open guide groove 37 and out of this open guide groove 37 again. The lock lever 36 has an extension on its side facing away from the guide groove 37 and a recess 41 is provided therein which forms an abutment with the pin 15 in the support positions 29*a*, 29*b*.

In the position shown in FIG. 6, the door 1 has been pivoted out so far that it does not abut the body on the subsequent parallel displacement into the position shown in FIG. 8.

On the closing movement of the door 1, it is first displaced in parallel from the position shown in FIG. 8 into the position of FIG. 6. In the position of FIG. 6, the lock bolt 38 engages into the guide groove 37 of the lock lever 36. The door 1 can now be closed by a pivoting of the articulated arm 7 and of the associated four-bar linkage.

The example pivoting/sliding doors provided herein have two opening functions, namely the opening function "slide" and the opening function "pivot". Both functions can be carried out using one door hinge.

In the "pivot" function, the closed door is opened like a conventional pivot door with a pivot movement. In the "slide" function, the closed door is opened and closed with a linear movement in the sliding direction.

It is possible by the explained designs to open a vehicle door selectively as a pivoting door or as a sliding door. The unlocking or control can be made possible by an actuation at the outer side and/or at the inner side of the door, and indeed mechanically and/or electrically and/or by remote control. The guide for the sliding function is preferably located in the vehicle door. It is possible to design the guide rail in a replaceable manner. The guide rail can be made as a pressed section, a rolled section or as a hybrid part. The guide carriage can be guided at the top and/or bottom in the guide rail. The guide carriage can furthermore be guided in the section side in the guide rail. The components for the guide, that is the guide rail and/or the guide carriage, can be realized in steel, aluminum and/or plastic. The surface of the guide rail can be machined. It can in particular be lacquered, powdered, anodized or chromium plated. The guide rail can furthermore be covered by a panel. The panel can be realized in plastic, aluminum or steel. The surface of the panel can be lacquered, powdered, anodized or chromium plated.

As can be seen from FIG. 2, the door is rotated in the direction of rotation X in the hinge 9 so far out of the side wall of the vehicle 2 that the required freedom between the door box 3 and the side wall of the vehicle is ensured for the following linear movement.

The invention claimed is:

1. A system comprising:

a motor vehicle; and a door, the door comprising:

a pivot joint that is configured to be locked;

an articulated arm hingedly connectable to the vehicle and pivotably supported at the pivot joint;

a guide carriage displaceably guided by a guide rail and coupled to a vertical swivel pin of the pivot joint;

a tie rod having a first end and a second end, the first end of the tie rod being hingedly connected to the guide carriage;

an index bolt which is biased in a vertical direction by a spring; and a rotary slide having a rotary slide surface which dictates vertical movement of the index bolt between a first position in which the articulated arm and the second end of the tie rod are engaged by the index bolt so that the articulated arm and the tie rod rotate together and a second position in which the second end of the tie rod is disengaged from the index bolt so that the articulated arm pivots relative to the tie rod.

2. The system of claim 1, wherein the pivot joint is configured to be locked in a first pivot position which enables the door to rotate outwardly from the vehicle and a second pivot position which enables the door to slide relative to the vehicle.

3. The system of claim 1, wherein a pivot range of the pivot joint is limited.

4. The system of claim 1, wherein a lock lever is pivotably supported on the guide carriage.

5. The system of claim 4, wherein the lock lever has a guide groove for receiving a lock bolt.

6. The system of claim 1, wherein the vehicle further includes one or more additional doors.

7. The system of claim 1, wherein when the index bolt is in the first position, the door is pivotally moveable relative to the vehicle, and when the index bolt is in the second position, the door is slidably moveable relative to the vehicle.

8. The system of claim 1 further comprising a swivel pin which pivotally supports the articulated arm, wherein the swivel pin is coupled to the vehicle.

9. The system of claim 8, wherein when the pivot joint is in a locked position, the door is opened by a pivot movement of the door relative to the vehicle, and when the pivot joint is in an un-locked position, the door is opened by a sliding movement of the door parallel to the vehicle.

10. The system of claim 9, wherein when the pivot joint is in the locked position, the tie rod and the articulated arm are interconnected by the index bolt, and when the pivot joint is in the un-locked position, the tie rod is able to rotate relative to the articulated arm.

11. A door for a vehicle, comprising:

a pivot joint which pivotally supports an articulated arm hingedly connectable to the vehicle, wherein the pivot joint is lockable, and when the pivot joint is in a first locked position, said joint enables the door to pivot away from the vehicle, and when the pivot joint is in a second locked position, said joint enables the door to slide along the vehicle;

a guide carriage displaceably guided by a guide rail and coupled to a vertical swivel pin of the pivot joint;

a tie rod having a first end and a second end, the first end of the tie rod being hingedly connected to the guide carriage;

an index bolt which is biased in a vertical direction by a spring; and a rotary slide having a rotary slide surface which dictates vertical movement of the index bolt between a first position in which the articulated arm and the second end of the tie rod are engaged by the index bolt so that the articulated arm and the tie rod rotate together and a second position in which the second end of the tie rod is disengaged from the index bolt so that the articulated arm pivots relative to the tie rod.

12. The door of claim 11, wherein movement of said joint between said first and second locked positions is mechanically controlled.

13. The door of claim 11, wherein movement of said joint between said first and second locked positions is controlled from an inner side of the vehicle.

14. The door of claim 11, wherein movement of said joint between said first and second locked positions is controlled from an outer side of the vehicle.

15. The door of claim 11, wherein movement of said joint between said first and second locked positions is remote controlled.

16. The door of claim 11, wherein the guide rail is covered by a panel.

* * * * *